US008657267B2

(12) United States Patent
Bodas

(10) Patent No.: US 8,657,267 B2
(45) Date of Patent: Feb. 25, 2014

(54) JET STREAM GENERATING METHOD AND APPARATUS

(75) Inventor: Janos Bodas, Huba (HU)

(73) Assignee: SPX Cooling Technologies, Inc., Overland Park, KS (US)

( * ) Notice: Subject to any disclaimer, the term of this patent is extended or adjusted under 35 U.S.C. 154(b) by 552 days.

(21) Appl. No.: 12/956,865

(22) Filed: Nov. 30, 2010

(65) Prior Publication Data

US 2012/0133063 A1 May 31, 2012

(51) Int. Cl.
*B01F 3/04* (2006.01)

(52) U.S. Cl.
USPC ..... 261/112.1; 261/113; 165/96

(58) Field of Classification Search
USPC ..... 261/108, 111, 112.1, 113, DIG. 10; 165/96, 104.11
See application file for complete search history.

(56) References Cited

U.S. PATENT DOCUMENTS

| | | | | |
|---|---|---|---|---|
| 764,049 | A * | 7/1904 | Guldlin | 261/113 |
| 2,227,465 | A * | 1/1941 | Roche, Jr. et al. | 261/112.1 |
| 3,518,816 | A * | 7/1970 | Jalma | 96/326 |
| 3,635,039 | A | 1/1972 | Power et al. | |
| 3,775,948 | A * | 12/1973 | Beam | 96/313 |
| 3,864,214 | A | 2/1975 | Ohakas | |
| 3,935,902 | A | 2/1976 | Heller et al. | |
| 4,107,241 | A * | 8/1978 | Braun | 261/79.2 |
| 4,337,069 | A | 6/1982 | German, Jr. et al. | |
| 4,759,315 | A * | 7/1988 | Chiou et al. | 122/442 |
| 4,981,113 | A * | 1/1991 | Kannan et al. | 122/441 |
| 5,480,595 | A * | 1/1996 | Yeoman et al. | 261/114.1 |
| 6,325,361 | B1 * | 12/2001 | Van Duijn | 261/113 |

FOREIGN PATENT DOCUMENTS

| | | |
|---|---|---|
| FR | 2425258 A1 | 12/1979 |
| FR | 2253997 B1 | 5/1981 |
| JP | 1004202 A | 1/1989 |

OTHER PUBLICATIONS

A Search Report in the corresponding Turkish Application No. 2011/07692, Jun. 2012.

* cited by examiner

*Primary Examiner* — Charles Bushey
(74) *Attorney, Agent, or Firm* — Baker & Hostetler LLP

(57) ABSTRACT

A condensing system is provided. The condensing system may include baffle plate units having a substantially flat surface and openings configured for cooling fluid to flow through; and baffles attached to the baffle plate unit, the baffles oriented at an acute angle with respect to the baffle plate unit, the baffles having a flat surface and figured to diffuse a cooling fluid into a thin, turbulent film at a similar acute angle. A method of condensing a fluid is provided. The method includes defining a path for the fluid to be condensed to flow; spraying a cooling fluid against a baffle thereby creating a turbulent film of cooling fluid in the path for the fluid to be condensed and orienting some of the baffles to create a film of cooling fluid oriented in one direction and orienting other baffles to create a film of cooling fluid in a second direction wherein the path of the fluid to be condensed causes the fluid to be condensed to flow over films oriented in both the first and second directions.

11 Claims, 5 Drawing Sheets

JET STREAM GENERATING METHOD AND APPARATUS

FIELD OF THE INVENTION

The present invention relates generally to a method and apparatus for condensing a fluid. More particularly, the present invention relates to a spray system for direct contact condensers.

BACKGROUND OF THE INVENTION

Due to the increasing water shortages all over the world, an increasing number of the new, large capacity thermal power plants are equipped with air-cooling systems.

There are two main versions of air-cooling systems suitable for power plant cooling, the direct steam condensing in an air cooled condenser, (ACC) and the indirect cooling tower (IDCT) cooling systems. In the direct ACC system the exhaust steam of the steam turbine is introduced into the air cooled steam-air heat exchangers of a mechanical draft cooling tower, whereas the indirect IDCT system uses water cooled condensers (surface or direct contact types), and the warmed cooling water is introduced into the water-air heat exchangers of a mechanical or natural draft cooling tower. The subject of the present invention is related to an advanced spray system of the direct contact (DC) condensers of large capacity indirect IDCT cooling plants Except the first filling up of the circulating water system, IDCT plants usually don't need any cooling water make up for their operation during the life-time of the power plant they serve. The water to be used for the first filling of the cooling system can be taken from the water treatment plant of the power station, therefore its quality can be the same as that of the feed water of the boiler-turbine circuit. Consequently the cooling water and the steam condensate can be mixed in the condenser, which means that for IDCT plants direct contact, DC condensers can be used.

In DC condensers there are no expensive titanium or stainless steel tubes, the heat from the condensing steam is transferred to the sprayed in cooling water by thin, turbulent water films, produced by the spray system of the condenser. The heat transfer coefficient between the condensing steam and the turbulent water films is extremely high, in the range of 60,000-70,000 $W/m^2K$, whereas that in case of surface condensers is 6000-7000 $W/m^2K$ only.

High heat transfer coefficient means small terminal temperature difference (TTD) in the DC condenser. With well-designed spray system 0.5-0.8° C. TTD can be achieved with DC condensers and with surface condensers with economically fair design 3-5° C. can be reached only. A 1° C. decrease in the TTD means 3.3% saving in the investment cost of the whole cooling plant, therefore in case of the above mentioned examples 8.2-13.8 saving in the investment cost is expected by the use of DC condensers instead of surface types.

The cost of the DC condenser itself is about 1/10 that of the surface ones. The above examples well illustrate the importance of a well-designed spray system of the DC condensers.

Accordingly, it is desirable to provide an effective and efficient cooling system.

SUMMARY OF THE INVENTION

The foregoing needs are met, to a great extent, by the present invention, wherein in one aspect an apparatus is provided that in some embodiments provide an efficient cooling system.

In accordance with one embodiment of the present invention, a spray system is provided. The spray system may include a baffle plate unit having a substantially flat surface and openings configured for cooling fluid to flow through; and baffles attached to the baffle plate unit, the baffles oriented at an acute angle with respect to the baffle plate unit, the baffles having a flat surface and figured to diffuse a cooling fluid into a thin film at a similar acute angle.

In accordance with another embodiment of the present invention, a spray system is provided. The spray system may include a means for support having a substantially flat surface and openings configured for cooling fluid to flow through; and means for diffusing a fluid attached to the means for support, the means for diffusing at an acute angle with respect to the means for support, the means for diffusing having a flat surface and figured to defuse a cooling fluid into a thin film at a similar acute angle.

In accordance with yet another embodiment of the present invention, a method of condensing a fluid is provided. The method includes defining a path for the fluid to be condensed to flow; spraying a cooling fluid against a baffle thereby creating a film of cooling fluid in the path for the fluid to be condensed to flow at an acute angle with respect to the flow path of the fluid to be condensed; and orienting some of the baffles to create a film of cooling fluid oriented in one direction and orienting other baffles to create a film of cooling fluid in a second direction wherein the path for the fluid to be condensed causes the fluid to be condensed to flow over films oriented in both the first and second directions.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
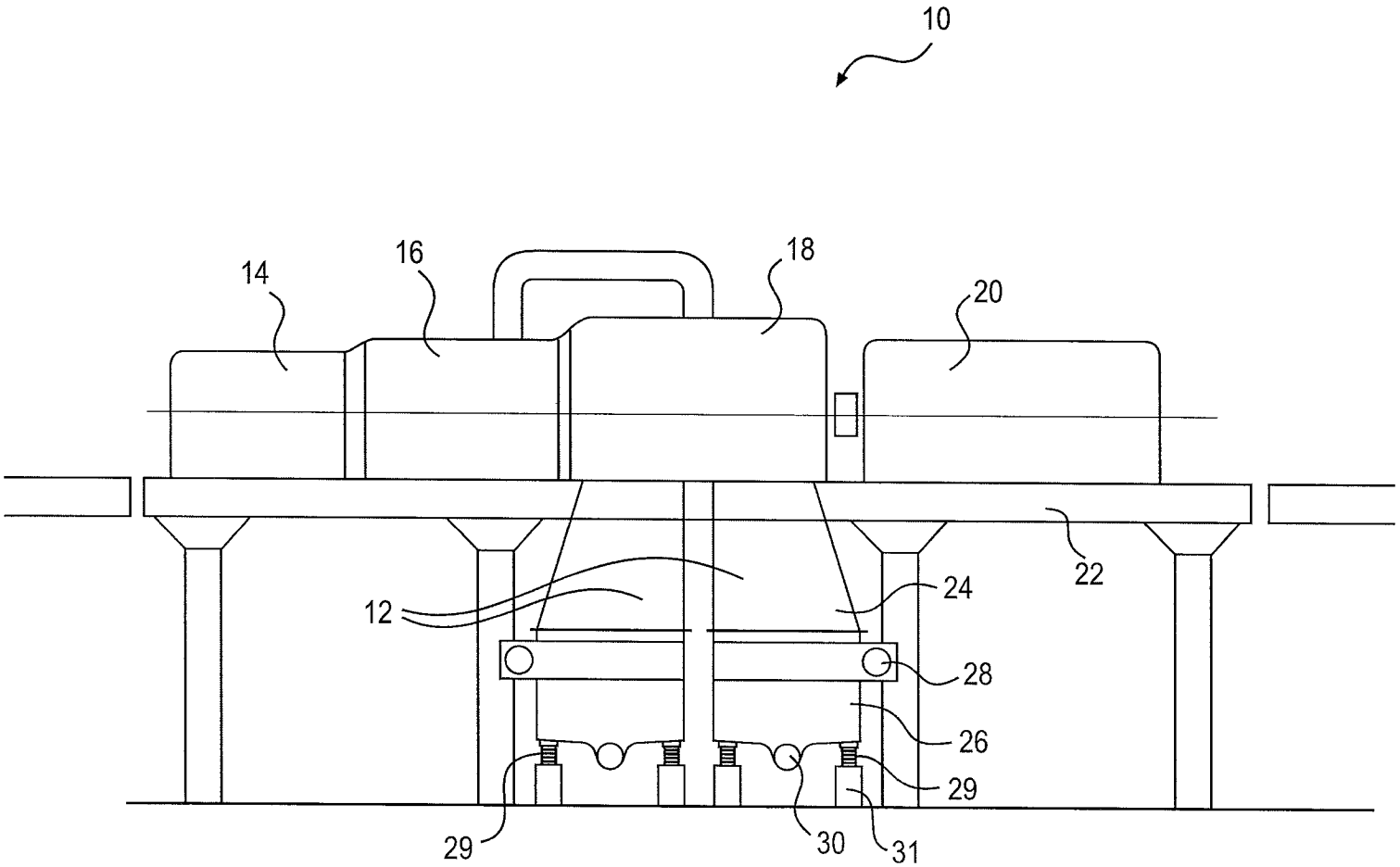
FIG. 1 is a side view of a steam turbine with twin DC condensers.

The invention will now be described with reference to the drawing figures, in which like reference numerals refer to like parts throughout. An embodiment in accordance with the present invention provides a spray system, which allows the design of a compact and more efficient condenser type than the currently used ones, and spray nozzles, which apart from fulfilling the thermo-technical requirements are less expensive than the currently known spray nozzles and can be manufactured with modern, highly productive automatic machine tools.

FIG. 1 shows a steam turbine 10. Twin condensers 12 are attached to the turbine. The condensers 12 are used to condense the steam by forcing the steam to flow over and exchange heat with a cooling fluid. While steam is described herein as the fluid to be condensed, the invention is not limited to steam. Other fluids could also be condensed using principles described herein.

While water is described herein as the cooling fluid, the invention is not limited to water. Other fluids could be used as the cooling fluid using principles described herein.

The turbine 10 includes high pressure 14, medium pressure 16 and low pressure 18 cylinders. The turbine 10 and generator 20 are mounted on a support frame 22. The turbine 10 is operatively connected a generator 20 for generating electricity. Other embodiments of the invention may be applied to cooling devices that may or may not be associated with a turbine 10.

The low pressure turbine 18 has a double exhaust system, therefore two similar DC condensers 12, one right and one left, are connected via two diffusers or connecting conduit 24 to the exhaust parts of the turbine 10. In some embodiments the two condensers 12 are very similar or the same as each other. Thus, only one condenser 12 will be explained in detail. The condenser 12 will be described later further below.

Cooling water enters the condenser 12 through a cold cooling water inlet nozzle 28, and warmed cooling water leaves the condenser body 26 through a warm cooling water outlet nozzle 30. The condensers 12 are supported by spring 29 supporting pieces 31, which allow free heat expansion movements both horizontally and vertically.

Figure 2:
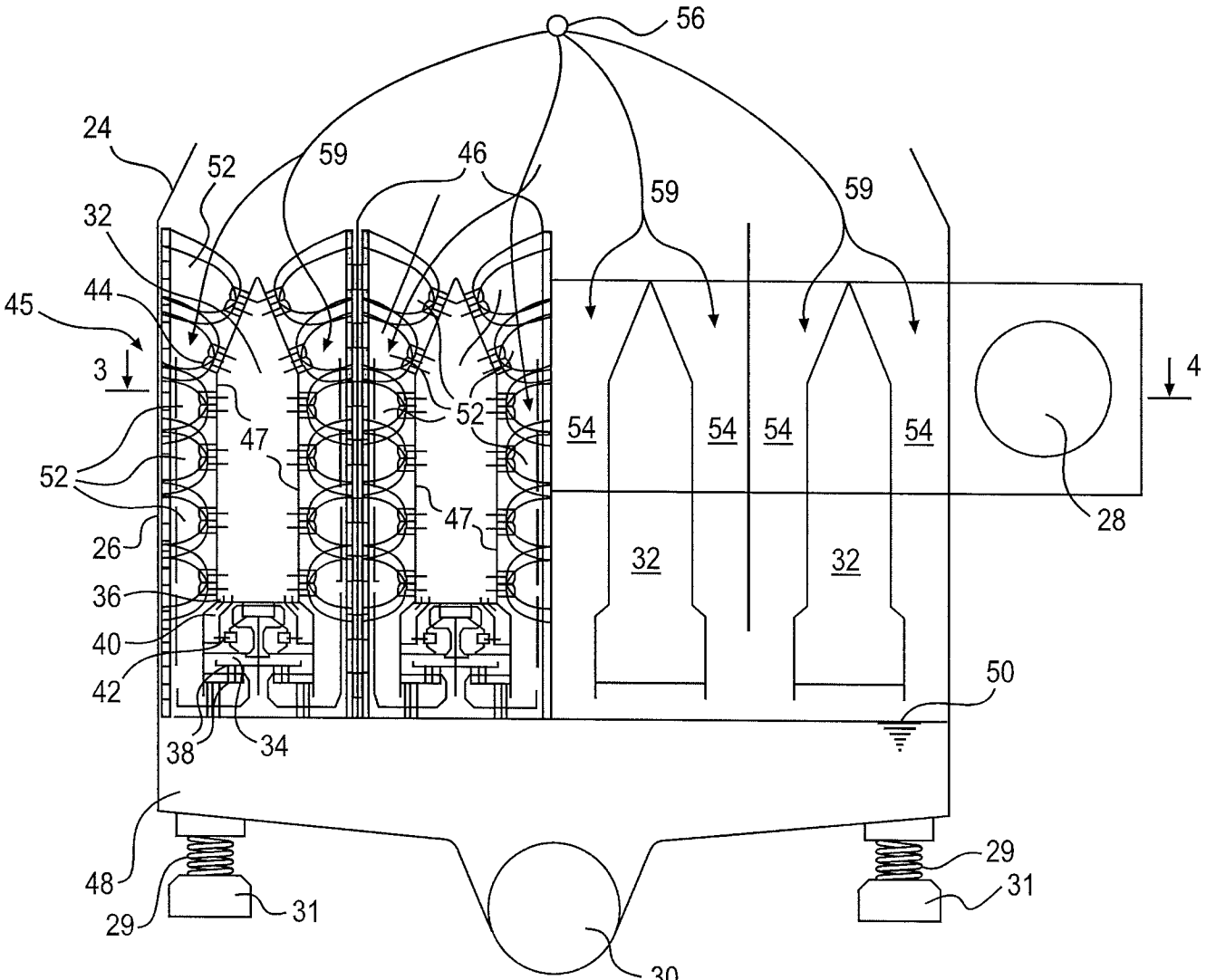
FIG. 2 is partial cross-section view of a DC condenser.

The simplified structure of a DC condenser 12 equipped with the spray system is accordance with the present invention is illustrated on FIG. 2. Some features of the condenser 12 not relevant or are known are not shown in order to avoid crowding of the FIGS.

In FIG. 2 the fabricated condenser body 26 has, as an example four cooling water distributing chambers 32. More or fewer cooling water distributing chambers 32 could also be used. The cooling water distributing chambers 32 on the right of FIG. 2 and vertical steam paths 54 are shown with several features removed to avoid over crowding of FIG. 2. The cooling water distributing chambers 32 and vertical steam paths 54 between the water films on the left shown more detail. Steam to be condensed enters the condenser 12 through the steam inlet 56. The steam then travels through the steam paths 59 in the directions shown by the arrows in FIG. 2.

The steam is condensed as it passed over the films 52 of cooling fluid. The films 52 are fan shaped as shown in FIG. 2. Once the steam has contacted the water films, some or all of the steam may condense into water and collect into the hot well 48. Line 50 illustrates a water level in the hot well 48. The water may leave the hot well 48 via the warm cooling water outlet nozzle 30.

An air cooling section 34 is connected to the bottom part of each distributing chamber 32. A vent pipe 36 transfers the remaining steam/air mix towards vacuum pump (not shown in FIG. 2) of the steam turbine 10. Perforated trays 38 form a counter flow cascade air-cooling heat exchanger.

The spray nozzles 42 in the air cooling section 34 spray cooling water into the steam air mix. Then the cooling water films drop onto the topmost perforated trays 38 of the air cooling section 34, and cascade down, onto the lower tray(s) in counter flow with the incoming steam/air mix. Water supply channels 40 provide the cooling water for these spray nozzles 42. The cooling water quantity sprayed into the air-cooling section 34 is about 4-5% of the total circulated cooling water.

Spray nozzles 44 in the main condenser section 45 are arranged in double rows on the sidewalls 47 of the cooling water distributing chambers 32. The plane 49 of the baffle plates 62 (shown in FIG. 6) are inclined relative to the sidewalls 47 of the cooling water distributing chambers 32. Consequently the water films 52 produced are also inclined. The bulk of the total cooling water (about 95%) is sprayed into the condenser 12 through the spray nozzles 44 of the main section 45. The water flow of spray nozzles 44 in the main compartment 45 of the condenser 12 is in excess of that of the nozzles 42 in the air-cooling section 34.

Due to the inclined arrangement, the length of the water films 52 will be longer, at a given distance between the sidewall 47 of the cooling water distributing chambers 32 and the separating walls 46 compared with the length of water films 52 perpendicular to the wall 47 of the distributing chambers 32. The longer water films 52 provide larger heat transfer surface, and by these, improve the efficiency of the DC condenser 12.

Figure 3:
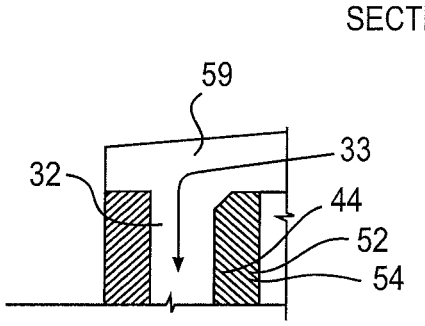
FIG. 3 is a partial cross-sectional view taken along the 3-4 in FIG. 2.
Figure 4:
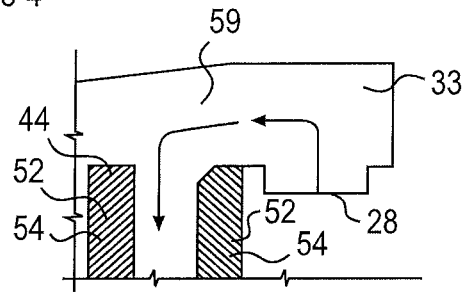
FIG. 4 is a partial cross-sectional view taken along the 3-4 in FIG. 2.

FIGS. 3 and 4 are partial cross-sectional views shown along line 3-4 of FIG. 2 of the cooling water distributing chambers 32. Cooling water flows through a cooling water inlet 28 into manifold 33, traversing cooling water flow paths 59 and into the cooing water distributing chamber 32. The cooling water is sprayed out of the cooling water distributing chamber 32 through nozzles 44. The streams of water 51 hit a baffle plate 62 (shown in FIG. 6) and are diffused into thin films 52 in the vertical steam channels 54. The nozzles 44, the water films 52 and the vertical steam channels 54 are represented in FIGS. 3 and 4 by diagonal hatch lines.

Figure 5:
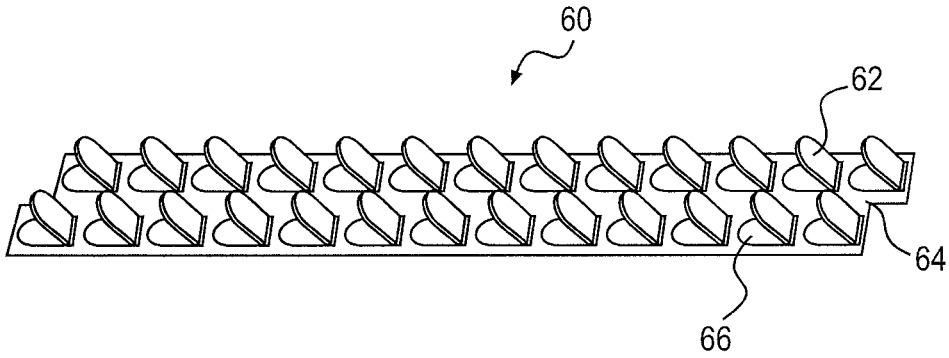
FIG. 5 is a perspective view of a baffle plate in accordance with an embodiment of the invention.
Figure 6:
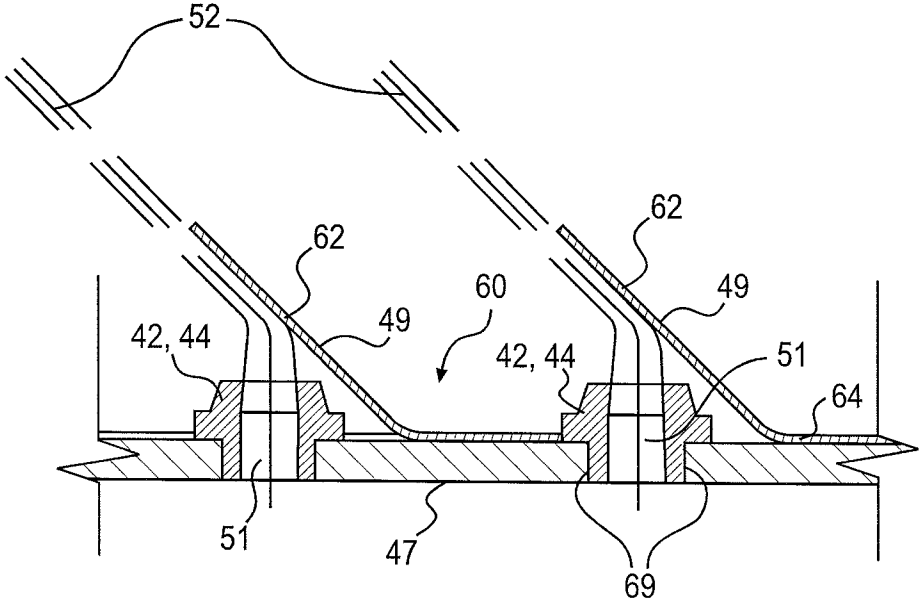
FIG. 6 is a cross-sectional view of the side wall of the water distributing chamber, together with the section of the spray nozzles and baffle plates in a DC condenser in accordance with the invention.

The baffle plate units 60 as shown in FIG. 5 can be made without any scraps. For example, the baffle plates 62 may be cut out from a sheet 64 of stainless steel on all but one side. Plastics may also be used. The baffle plates 62 may be bent (similar to a hinge movement) along the uncut side to extend from the sheet 64 as shown in FIGS. 5 and 6 to form openings 66. Alternatively, the baffle plates 62 may be cut completely from the sheet 64 and then fixed to the plate 64 by welding to any other suitable method. Other techniques for fabricating the baffle units 60 may also be used. The baffle units 60 may be fixed to the sidewalls 47 of the cooling water distributing chambers 32 by spot welding or any other suitable method.

FIG. 6 shows the nozzles 42, 44 attached to the sidewalls 47 via fine pitch threads 69. The threads are fine enough that the nozzles 42, 44 do not require resilient members such as a gasket to attach to the wall 47 in a watertight manner. The stream 51 of water is sprayed or squirted out of the nozzles 42, 44 at a substantially right angle to the wall 47. The stream 51 hits the baffle 62 and is diffused to a fan shaped film 52. As shown in FIG. 6 the diameter of the nozzles 42, 44 decreases as the stream of water 51 exits the nozzles 42, 44.

The spray nozzles 42, 44 in accordance with the invention is illustrated in FIG. 6. The nozzle bodies 42, 44 may be a simple design, to be made expediently of hexagonal, stainless steel cold drawn rods. It is possible to manufacture the required large number of nozzles 42, 44 by turning the rods on highly productive, automatic machine tools.

The baffle plates 62 are cut and punched from stainless steel strips. A baffle plate unit 60 can consist of arbitrarily chosen number of baffle plates, 62 suitable for given size of cooling water distribution chambers 32.

Figure 7:
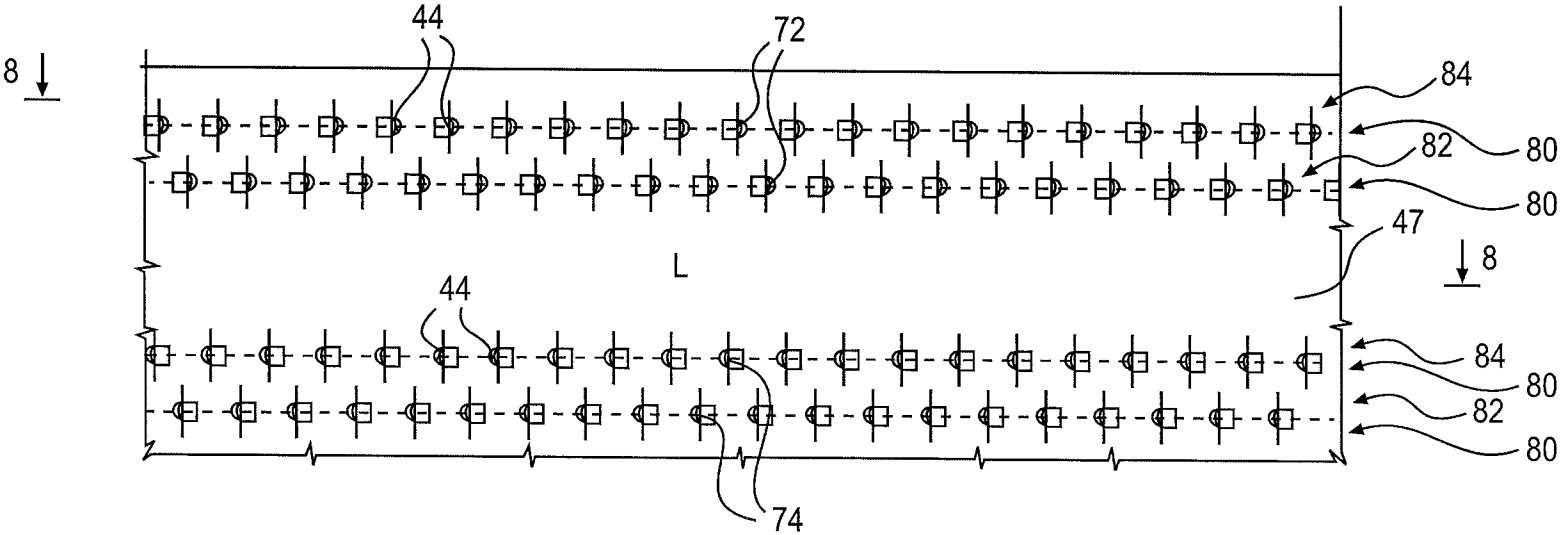
FIG. 7 illustrates an arrangement and design of the spray nozzles and baffle plate in accordance with an embodiment of the invention.

In an example embodiment as shown in FIG. 7, the horizontal pitch of (or the distance between the spray nozzles 44 is 78.3 mm in each nozzle row 80 and the distance between the water films produced is 60 mm. In each nozzle row pairs 82, 84 the lower rows 82 are offset by 39 mm relative to the higher rows 84 of the pair, and this way the resulting distance between the water films 52 will be 30 mm.

Figure 8:
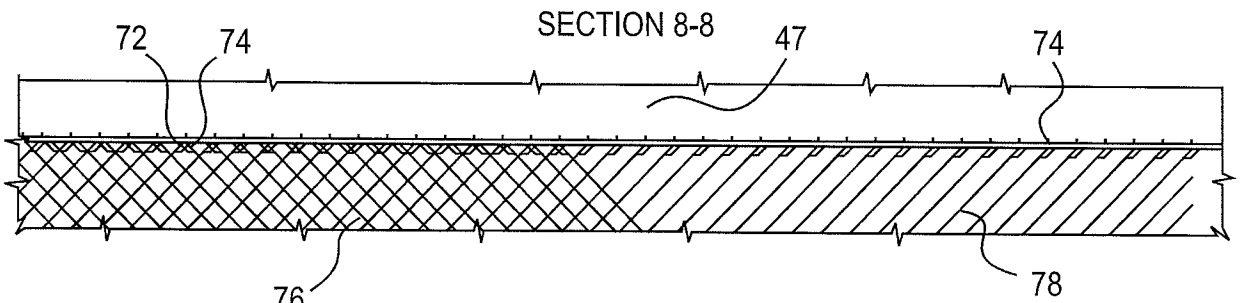
FIG. 8 is a cross-sectional view of the spray nozzles and baffle plates taken along line 8-8 shown in FIG. 7.

In another embodiment in accordance with the invention and as shown in FIGS. 7 and 8, the inclination of the plane 49 of the baffle plates 62 of the spray nozzle 44 and the water films 52 in the successive row pairs 82, 84 are alternately oriented to the right and left. This way the water films 52 of the successive row pairs 82, 84 are crossing each other. In this arrangement water films 52 of the upper row pairs 82, 84 cannot drop with their full length onto the water films 52 of the next, lower rows pair 82, 84. Expectedly with this arrangement the heat transfer between the condensing steam and the water films 52 is improved.

The hydrostatic pressure in the horizontal spray nozzle rows 80 is increasing with the decreasing geodetic height of the nozzle rows 80. Consequently the water flow of the spray nozzle 44 of the lower rows is increased. From operating point of view this is not required, due to the fact, that the steam flow on the lower levels is less than in the higher levels. The optimum water flow of each nozzle 80 row can be achieved by using decreasing nozzle exit diameters in the lower nozzle rows 80.

FIG. 8 is a cross-sectional view of the wall 47 along line 8-8 shown in FIG. 7. FIG. 8 shows the baffle plates inclined to the right 72 and the left 74 which cause water films oriented to the right 76 and the left 78.

It can be seen from the aforementioned description that the spray system and the pertaining spray nozzles 42, 44 in accordance with the present invention allow the implementation of more efficient and less expensive DC condensers 12 than the currently known ones. There is no need for expensive precision cast iron nozzles; inclined flat, turbulent water films provide improved heat transfer, hence more efficient performance, and simultaneously very compact and less expensive design.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A condensing system comprising:

a baffle plate unit having a substantially flat surface and openings configured for cooling fluid to flow through; and baffles attached to the baffle plate unit, the baffles oriented at an acute angle with respect to the baffle plate unit, the baffles having a flat surface and figured to diffuse a cooling fluid into a thin, turbulent film at a similar acute angle, wherein the baffles are aligned in longitudinal row pairs, and the baffles of one row are longitudinally spaced by a difference of a half pitch from the longitudinal spacing of the baffles in an immediate adjacent row, and wherein the row pairs of baffles are vertically spaced one above another and a lower row pair has nozzles having smaller diameters than the diameters on the nozzles of the row pair above.

2. A condensing system comprising:

a baffle plate unit having a substantially flat surface and openings configured for cooling fluid to flow through;

baffles attached to the baffle plate unit, the baffles oriented at an acute angle with respect to the baffle plate unit, the baffles having a flat surface and figured to diffuse a cooling fluid into a thin, turbulent film at a similar acute angle; and a nozzle configured to outlet a cooling fluid through one of the openings and substantially perpendicular to the substantially flat surface and contact the baffles at an acute angle and wherein the baffles are configured to direct the cooling fluid into a flat, turbulent, fan-shaped film.

3. The cooling system of claim 2, wherein the baffle plate unit is stainless steel.

4. The cooling system of claim 2, wherein the baffles are formed by cutting the baffle plate unit except one side and bending the cut baffles along this side thereby forming the baffle at the acute angle and the opening.

5. The cooling system of claim 2, wherein the baffles are aligned in rows, and some rows are configured to have the baffles align in a first direction and other rows are configured to have the baffles align in a second direction opposite the first direction.

6. The cooling system of claim 5, wherein the system is configured to spray a cooling fluid against the baffles such that some of the thin films created thereby will be angled in a first direction and others of the thin films will be angled in a second direction and a fluid to be condensed by the cooling fluid constituting the thin films will flow through films angled in the first direction and films angled in the second direction.

7. The cooling system of claim 2, wherein the baffles are aligned in longitudinal row pairs, and the baffles of one row are longitudinally spaced by a difference of a half pitch from the longitudinal spacing of the baffles in an immediate adjacent row.

8. A condensing system comprising:

a baffle plate unit having a substantially flat surface and openings configured for cooling fluid to flow through;

baffles attached to the baffle plate unit, the baffles oriented at an acute angle with respect to the baffle plate unit, the baffles having a flat surface and figured to diffuse a cooling fluid into a thin, turbulent film at a similar acute angle; and a nozzle configured to outlet a cooling fluid through one of the openings wherein the nozzle is non-corrosive material and is attached to a side wall via fine pitch threads in a substantially watertight manner.

9. The cooling system of claim 8, wherein the nozzle has a hexagonal outer cross-section and the bore is dimensioned to outlet a cooling fluid of a circular cross-section.

10. A condensing system comprising:

a baffle plate unit having a substantially flat surface and openings configured for cooling fluid to flow through;

baffles attached to the baffle plate unit, the baffles oriented at an acute angle with respect to the baffle plate unit, the baffles having a flat surface and figured to diffuse a cooling fluid into a thin, turbulent film at a similar acute angle; and a nozzle configured to outlet a cooling fluid wherein the nozzle has a conical bore of decreasing exit diameter.

11. A condensing system comprising:

a baffle plate unit having a substantially flat surface and openings configured for cooling fluid to flow through;

baffles attached to the baffle plate unit, the baffles oriented at an acute angle with respect to the baffle plate unit, the baffles having a flat surface and figured to diffuse a cooling fluid into a thin, turbulent film at a similar acute angle; and a steam powered turbine and a power generator operatively connected to the turbine wherein the cooling system is configured to condense the steam exhausted by the turbine.

* * * * *